US008736408B2

(12) United States Patent
Ashcraft et al.

(10) Patent No.: US 8,736,408 B2
(45) Date of Patent: May 27, 2014

(54) MAGNETIC ANCHOR

(75) Inventors: Britt C Ashcraft, Tomball, TX (US); Eric Chen, Houston, TX (US); Rudy Widiaman, The Woodlands, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 13/531,225

(22) Filed: Jun. 22, 2012

(65) Prior Publication Data

US 2013/0342295 A1 Dec. 26, 2013

(51) Int. Cl.
*H01H 9/00* (2006.01)

(52) U.S. Cl.
USPC ..... 335/219; 335/205

(58) Field of Classification Search
USPC ..... 335/219
See application file for complete search history.

(56) References Cited

U.S. PATENT DOCUMENTS

| | | | | |
|---|---|---|---|---|
| 2,498,683 | A * | 2/1950 | Hubbell | 200/571 |
| 4,199,741 | A * | 4/1980 | Paulet | 335/206 |
| 4,231,137 | A * | 11/1980 | Fujimoto | 24/303 |
| 5,024,072 | A * | 6/1991 | Lee | 70/491 |
| 5,369,912 | A * | 12/1994 | Ginzel et al. | 49/141 |
| 5,447,045 | A * | 9/1995 | Cheng | 70/58 |
| 6,640,398 | B2 * | 11/2003 | Hoffman | 24/303 |
| 6,971,254 | B2 * | 12/2005 | Bellow et al. | 70/14 |
| 7,028,513 | B2 * | 4/2006 | Avganim | 70/18 |
| 7,152,282 | B2 * | 12/2006 | Costa | 24/303 |
| 7,598,862 | B2 * | 10/2009 | Lastinger et al. | 340/547 |
| 7,663,483 | B2 * | 2/2010 | Spenik et al. | 340/547 |
| 7,667,600 | B2 * | 2/2010 | Woodbury et al. | 340/568.1 |
| 7,775,567 | B2 * | 8/2010 | Ligtenberg et al. | 292/251.5 |
| 7,894,186 | B2 | 2/2011 | Farrow et al. | |
| 8,001,812 | B2 * | 8/2011 | Mahaffey et al. | 70/58 |
| 2007/0139874 | A1 | 6/2007 | Tanaka | |
| 2008/0143525 | A1 * | 6/2008 | Woodbury et al. | 340/547 |
| 2008/0143526 | A1 * | 6/2008 | Spenik et al. | 340/547 |
| 2011/0146358 | A1 | 6/2011 | Avganim | |
| 2011/0296653 | A1 * | 12/2011 | Fiedler | 24/303 |

FOREIGN PATENT DOCUMENTS

| | | |
|---|---|---|
| CN | 2519312 | 10/2002 |
| CN | 1324425 | 11/2011 |

OTHER PUBLICATIONS

Inventables.Com. "Permanent Switchable Magnet", published online at [https://www.inventables.com/technologies/permanent-switchable-magnet], retrieved on Jun. 22, 2012. 9 pages.

* cited by examiner

*Primary Examiner* — Shawki S Ismail
*Assistant Examiner* — Lisa Homza

(57) ABSTRACT

A magnetic anchor that is attachable to a computing unit via a magnetic field. The magnetic anchor further includes a locking mechanism that enables its attachment/detachment to a surface area of the computing unit—and further connects to a cable that is fastened to a secured location.

14 Claims, 6 Drawing Sheets

MAGNETIC ANCHOR

BACKGROUND

Portable computer unit have become smaller and lighter, they have become easier to conceal. Such ease of portability and concealment has also increased risk of their theft, and hence protecting such units from unauthorized relocation has become increasingly paramount. To mitigate unauthorized relocation of such portable computing units, various forms of protections such as a "security device" or "merchandise display device," are developed. Such arrangements permit a potential purchaser to examine and operate the demonstration model, without increasing a likelihood that the display product will be stolen or removed. For example, various locking systems and arrangements have been provided, wherein lock structures have been designed to supply a mechanical grip on holes that are devised within sides of the computing units.

DETAILED DESCRIPTION

Figure 1:
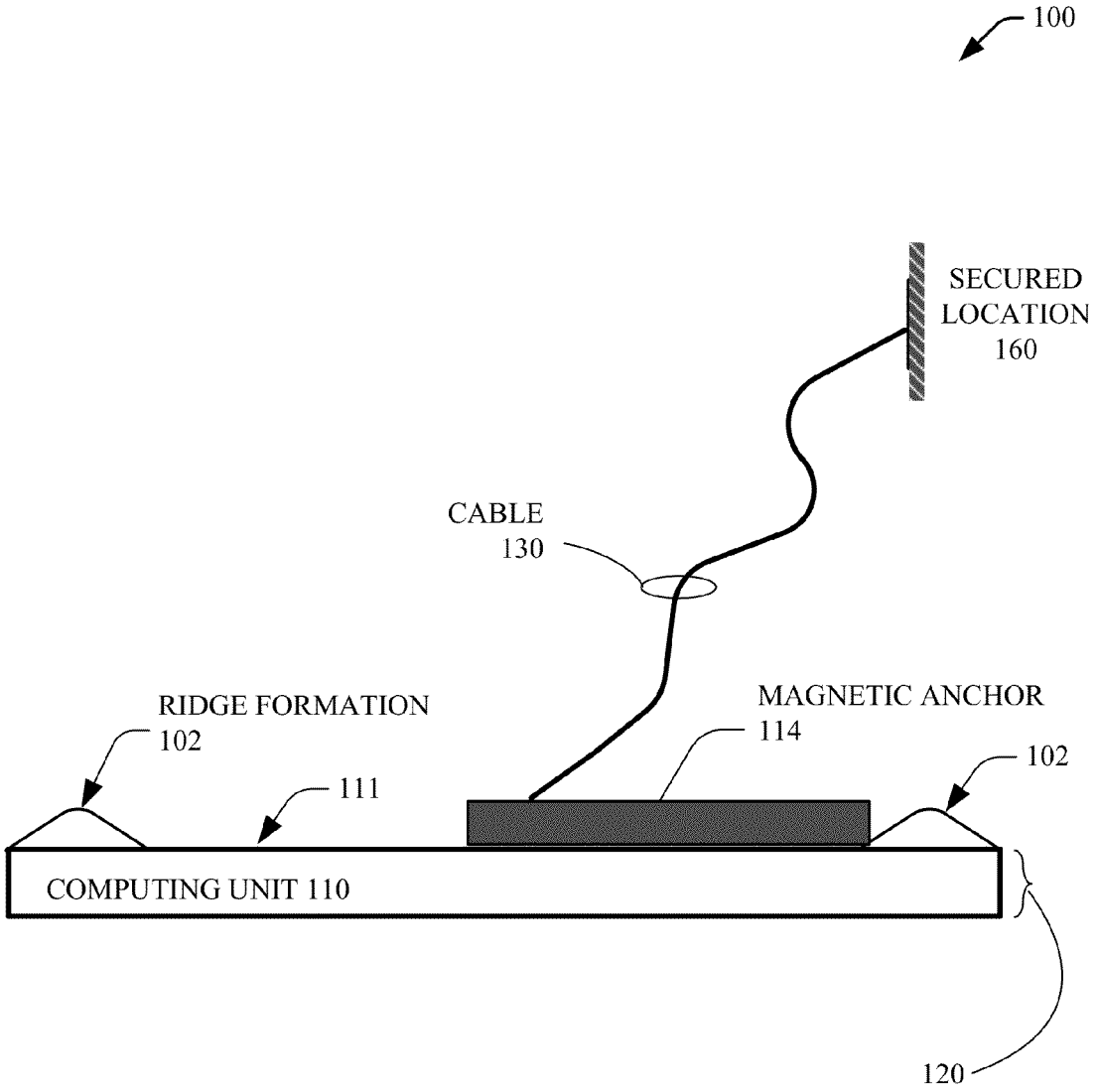
FIG. 1 illustrates an example of schematic elevation view for a magnetic anchor attachable to a computing unit according to an aspect of the subject disclosure.

Several examples are now described with reference to the drawings, wherein like reference numerals are used to refer to like elements throughout. In the following description, for purposes of explanation, numerous specific details are set forth in order to provide a more thorough understanding of one or more aspects. It is evident, however, that such embodiments can be practiced without these specific details. In other instances, structures and devices are shown in block diagram form in order to facilitate describing one or more embodiments. Moreover, it is to be appreciated that features illustrated are not necessarily "to-scale" and some features may appear disproportionate when compared to others.

Various aspects of the subject disclosure provide for a magnetic "anchor" that is attachable to a surface area of a portable computing unit, to prevent its unauthorized relocation & movement. In one aspect, the subject disclosure enables an antitheft arrangement, wherein the magnetic anchor attaches to a laptop surface/base area—and further connects to a cable that is fastened to a secured location, such as a: wall, table counter, and the like. Such surface of the laptop can further include a ridge formation that can function as a barrier to mitigate sliding of the magnetic anchor off from a surface of the laptop.

FIG. 1 illustrates an example of a schematic elevation view 100 for a magnetic anchor that is attachable to a computing unit, according to an aspect of the subject disclosure. The magnetic anchor 114 can include an arrangement for a plurality of ferroelectric elements, which enable attachment of the magnetic anchor 114 to the computing unit 110. The magnetic anchor 114 enables employing a surface 111 of the computing unit 110 for connection of the computing unit 110 to a secured location 160. In one aspect, the secured location 160 can represent any position, situation or place that hinders movement of the computing unit when it is connected thereto—as compared to the situation when such computing unit is not attached thereto. For instance, the secured location can include a body of matter that is capable of showing resistance when pulled upon (e.g., a table leg, a post, a cabinet, and the like.)

The secured location 160 can offer resistance (even if substantially minimal) to free movement of the computing unit 110, when attached thereto via a cable 130 or chord. Moreover, the computing unit 110 can itself include a body that houses internal components and have a display attached to the body, for example. It is to be appreciated that such description represents an example of the computing unit 110, and the subject disclosure is not so limited. The display can be hinged to the body, such that the display can be opened and closed relative to the body. For example, if the computing unit 110 represents a laptop, it can be designated and listed by three physical dimensions for its size: namely, width, depth and height or thickness.

The width can refer to a size of the laptop frame from the left side of the keyboard to the right. Likewise, depth can refer to size of a system from front of the laptop to the back panel hinge, wherein such depth excludes an oversized battery, for example. Similarly, height or thickness can refer to a dimension from a bottom of the laptop to the back of the display, when the laptop is closed.

In this regard, as the height or thickness of laptops become increasingly thinner—the subject disclosure enables a surface area created by width and depth dimensions of the laptop (e.g., a back surface of the display housing), to be employed for securing the laptop against unauthorized relocation, for example.

In a related aspect, a ridge formation 102 can supply additional support against the magnetic anchor 114 gliding on the surface 111 and slipping away from such surface. The ridge formation 102 can be molded as part of a surface of the computing unit 110, or can be a separate part that is attachable thereto, for example. Accordingly, the ridge formation can add resistance to a motion of the magnetic anchor in a direction that can result in a slipping thereof from a surface 111.

Furthermore, the magnetic "anchor" 114 can be attached/detached from the surface area 111 of the portable computing unit 110, as required to selectively prevent its unauthorized relocation & movement. Stated differently, the subject disclosure enables an antitheft arrangement, wherein the magnetic anchor 114 can attach to a surface or base area of the computing unit 110—and further connect to a cable 130 that is fastened to a secured location 160, such as a: wall, table counter, and the like. Moreover, the ridge formation 102 can include any type of configuration (e.g., rectangular, triangular, and the like), which can be raised from the surface 111, to mitigate sliding of the magnetic anchor 114 as described above.

Figure 2:
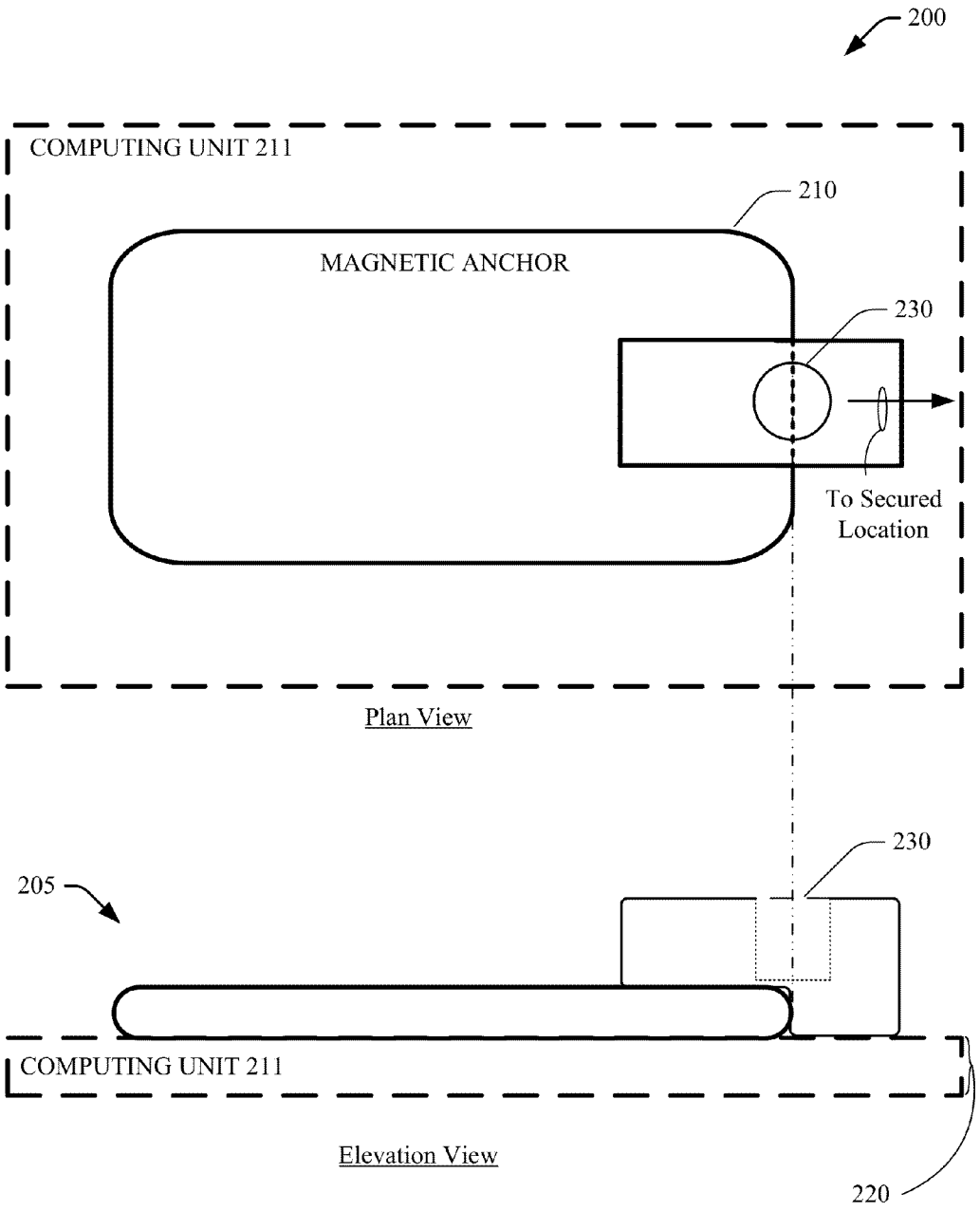
FIG. 2 illustrates a further example of a schematic view for a magnetic anchor that is attachable to a laptop.

FIG. 2 illustrates a further example for a plan view 200 and an elevation view 205 of a magnetic anchor 210 in accordance with an aspect of the subject disclosure. The magnetic anchor 210 includes ferromagnetic materials/elements such as; iron, nickel, cobalt and their alloys. These materials enable occurrence of ferromagnetism as an internal driving force that causes parallel alignment of the spins of the electrons and presence of an internal interaction between localized moments represented by the molecular field. Moreover, the magnetic anchor 210 can substantially represent a planar arrangement, which can spread across a surface area of the computing unit 211, and hence is not encumbered by same limitations of anchoring arrangements that rely on mechanical fastening to a height or thickness 220 of the computing unit 211 that is increasingly become thinner, and hence supplying less surface to exploit for anchoring a cable or chord thereto.

For example, the magnetic anchor 210 can include at least two pairs of plate-shaped pole plates (not shown) with a permanent magnet arrangement sandwiched therebetween—wherein each pair of pole plates can be separated by a non-magnetic medium. The permanent magnet arrangement can consist of a fixed magnet, having a circular opening, and a disc shaped magnet rotatable in the opening, for example. The two magnets can be magnetized in the direction of their smallest dimension with portions of each having opposite magnetic polarity. Moreover, portions of the stationary magnet can be arranged to magnetize the pole plates with opposite magnetic polarity. The disc shaped magnet, in one position, can exhibit magnetic polarity which coincides with that of the stationary magnet, and hence can reinforce its magnetic force and in another position, has magnetic polarity in opposition to the magnetic polarity of the fixed magnet whereby to oppose and reduce the flux in the pole plates.

As such, a switchable magnetic arrangement can be created that can switch to enhance the magnetic field (e.g., an ON position), or to mitigate and/or cancel a magnetic field (e.g., an OFF position). For example, the pole plates of high permeability lying upon the pole faces of the permanent magnet arrangement can collect vectors/lines of magnetic force that emanate from lateral surfaces of the pole faces in high concentration due to the small dimensions of the lateral surfaces, so that a strong exterior field is available for attaching to other ferromagnetic objects, which can be placed as part of a casing of the computing unit, for example.

Moreover, the stationary permanent magnet poles can further be arranged, such that one pair of poles magnetizes a pole plate of each pair of plates. Rotatable magnet poles can further be arranged (e.g., rotatable permanent magnets), such that in one position of rotation the poles magnetize a pole-plate of each pair to reinforce that of the stationary magnet; and alternatively in another position neutralize or oppose that of the stationary magnet whereby the holding device is switched on or off respectively. Rotating the magnets can further be enabled via a key that can be inserted in a receiving cavity 230 of a lock, for example. In various examples, as illustrated in the example of FIG. 2, the lock may be simultaneously in contact with, or mounted on, the anchor 210 and the computing unit 211. Other types of mechanisms and arrangements, such as a combination lock or biometric lock, may also be employed for rotating the magnets relative to each other.

Figure 3:
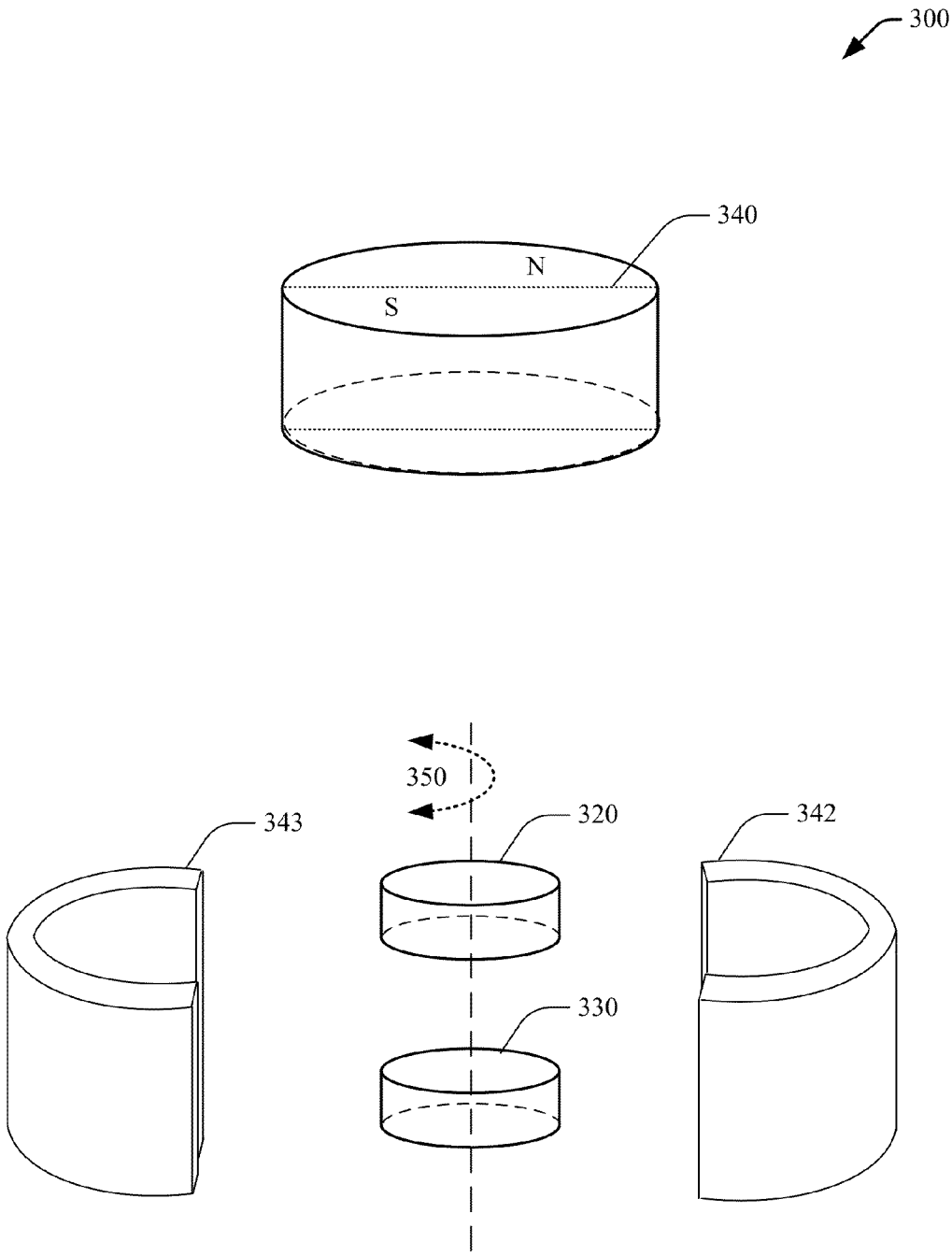
FIG. 3 illustrates a magnetic anchor arrangement that can be switched between On/Off positions, according to a particular aspect of the subject disclosure.

FIG. 3 illustrates a further example for an arrangement 300 of permanent magnets and/or ferromagnetic material as part of a switchable magnet that is part of the magnetic anchor, in accordance with an aspect of the subject disclosure. As illustrated, the magnetic anchor 300 can include a switchable magnetic device, which itself includes permanent magnets, namely a first disc shaped magnet 320 and a second disc shaped magnet 330—wherein such permanent magnets 320, 330 can be diametrically polarized (via a division between the north pole and the south pole of the magnet being achieved by a vertical plane 340 that passes along a diameter of the disc, for example.) Each of the the disc-shaped magnets 320, 330 can comprise a rare-earth type magnet, for example, each of the disc-shaped magnets 320, 330 can be a neodymium-iron-boron magnet.

Moreover, the first and second disc shaped magnets 320, 330 (e.g., a first permanent magnet and a second permanent magnet) can be mounted within the housing such that the first and second disc shaped magnets 320, 330 are rotatable in a clockwise or counter clockwise direction 350 relative to each other. In one aspect, the rotation of the first disc shaped magnet 320 and the second disc shaped magnet 330 can occur mechanically via an external force exerted by a user.

For example, a user can insert a key within a cavity or lock and via a twisting motion, rotate the first and second magnet relative to each other. Accordingly, a relatively strong external magnetic field can be created when the first and second permanent magnets 320, 330 are positioned relative to each other such that a north and south poles of the first magnet are in substantial alignment with respective north and south poles of the second magnet. When the north poles of the magnets are aligned the magnetic anchor can be attached to the computing unit Alternatively, twisting the key can result in an arrangement when the first and second magnets are positioned relative to each other such that the north pole of the first magnet is in substantial alignment with the south pole of the second magnet and vice versa. Such an arrangement presents a relatively weak external magnetic field, and hence the magnetic anchor can be detached from the computing unit (e.g., an "OFF" position.)

The disc shaped magnets can further be housed in pole pieces 342, 343. Such pole pieces 342, 343 can be fabricated from a material that is ferromagnetic with substantially low magnetic reluctance, for example. Moreover, the pole pieces 342, 343 can fixedly hold the second disc shaped magnet 330 (e.g., lower magnets) in a fixed position—and yet, the first disk shaped magnet 320 (e.g., upper magnets) can be rotated in a clockwise or counter clockwise direction 350 within the housing formed by pole pieces 342, 343. In one embodiment, various magnetic barriers or shields may be employed to contain the magnetic field, and hence avoid its interactions with electronic components that are sensitive to such fields.

Figure 4:
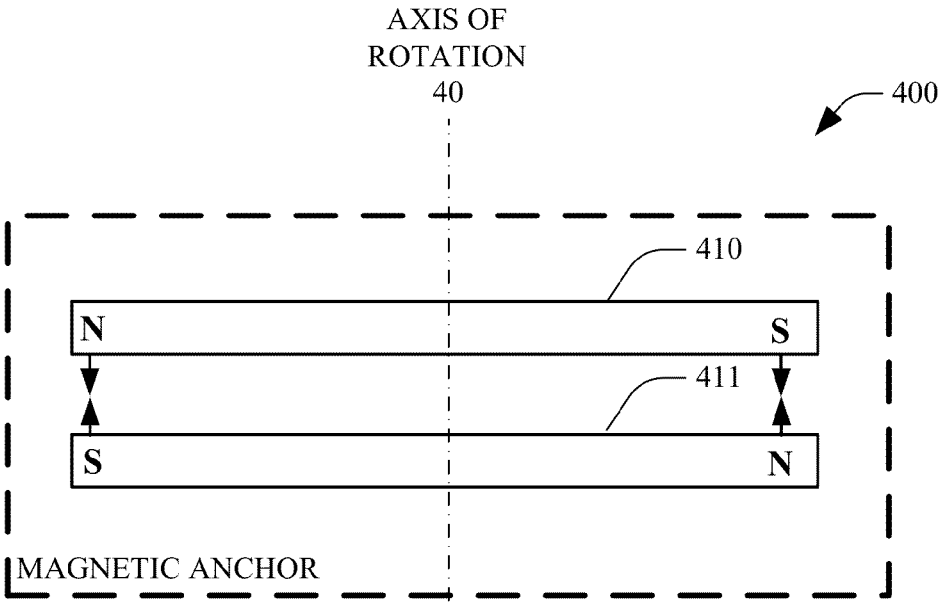
FIG. 4 & FIG. 5 illustrate examples for arranging permanent magnets as part of a magnetic anchor according to an aspect of the subject disclosure.
Figure 5:
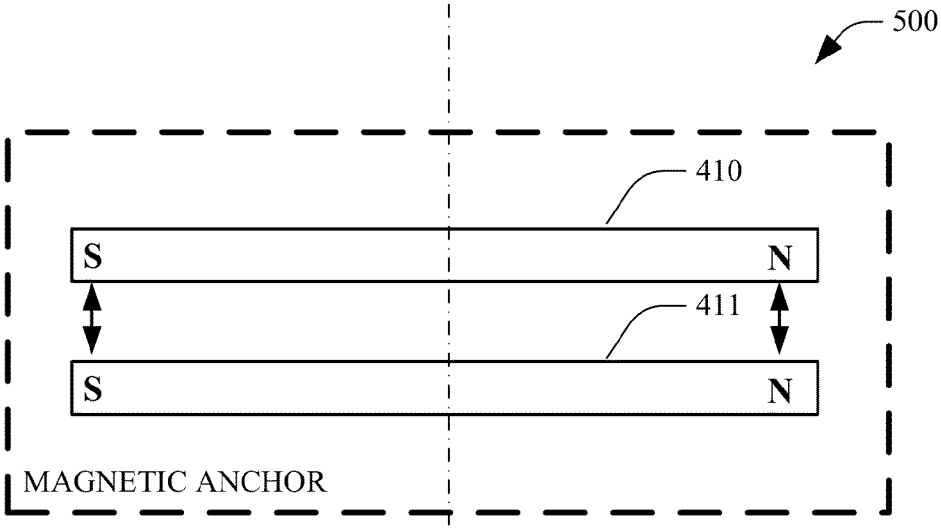

FIGS. 4 and 5 illustrate various schematics elevations for operational aspects of the magnetic anchor, wherein by rotating the magnets relative to each other, the magnetic fields can combine together (e.g., an "ON" position), or alternatively orient, such that the resulting magnetic fields operate to mitigate or cancel each other (e.g., an "OFF" position). In this regard, FIG. 4 & FIG. 5 illustrate the first magnet 410 and second magnet 411 being mounted such that first magnet 410 is below second magnet 411. The first magnet 410 and second magnets 411 are mounted, such that they are in face to face juxtaposition. For example, the first magnet 410 can be fixedly mounted, wherein the second magnet 411 is mounted for rotation about axis of rotation 40.

Accordingly, in FIG. 4 the second magnet 411 has been positioned such that its north pole substantially underlies the south pole of first magnet 410. Similarly, it follows that the south pole of second magnet 411 substantially underlies the north pole of first magnet 410. As such, the first magnet 410 and the second magnet 411 act as an internal active magnetic shunt and as a result the external magnetic field strength from the magnetic anchor 400 remains substantially low.

By rotating the first magnet 410 and the second magnet, 411 relative to each other and around the axis of rotation 40, the magnets can be positioned such that they are aligned as illustrated in FIG. 5. In such alignment, the respective north and south poles of the second magnet 411 substantially underlies respective north and south poles of first magnet 410. In this alignment, the external magnet field from the device remains substantially strong and the device can be firmly attached to ferromagnetic surfaces, which can be positioned in the computing unit. Hence, the magnetic anchor can be attachable to a surface area of a portable computing unit, to prevent its unauthorized relocation & movement. In this regard, the subject disclosure enables an antitheft arrangement, wherein the magnetic anchor attaches to a laptop surface/base area—and further connects to a cable that is fastened to a secured location, such as a: wall, table counter, and the like—for a safe guarding thereof.

Figure 6:
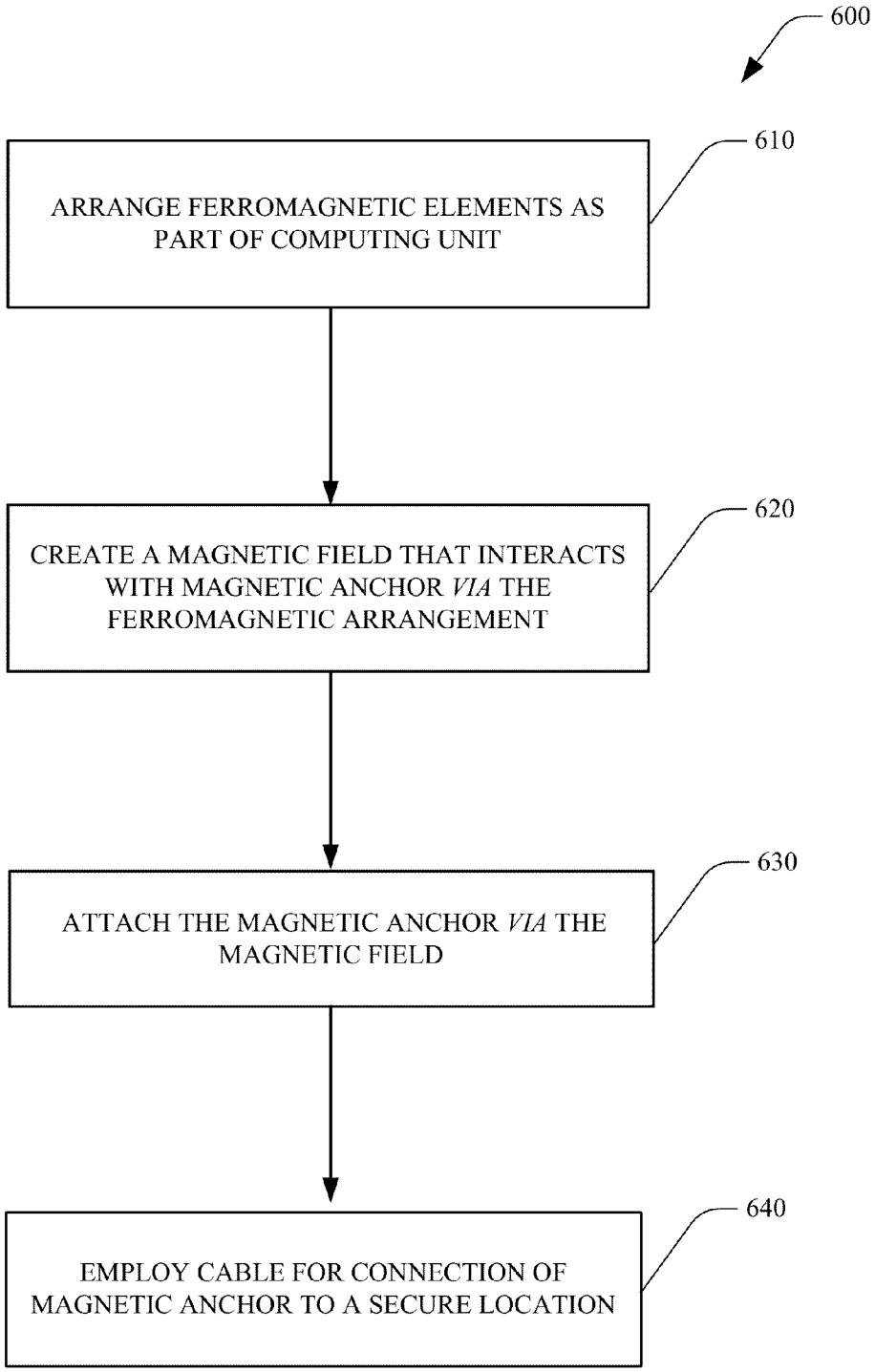
FIG. 6 illustrates an example for a particular methodology of supplying an antitheft arrangement in accordance with a further aspect of the subject disclosure.

FIG. 6 illustrates a methodology 600 of employing a magnetic anchor as part of an antitheft arrangement according to an aspect of the subject innovation. While this example is illustrated and described herein as a series of blocks representative of various events and/or acts, the subject innovation is not limited by the illustrated ordering of such blocks. For instance, some acts or events may occur in different orders and/or concurrently with other acts or events, apart from the ordering illustrated herein, in accordance with the subject disclosure. In addition, not all illustrated blocks, events or acts, may be required to implement a methodology in accordance with the subject innovation. Moreover, it is noted that the example method and other methods according to the innovation may be implemented in association with the method illustrated and described herein, as well as in association with other systems and apparatus not illustrated or described.

At 610, various ferromagnetic elements can be arranged and positioned as part of a computing unit, to facilitate operation of the magnetic anchor. For example, such arrangement can include positioning various permanent magnets that are in form of planar objects (or substantially planar objects)—such as disc shaped magnets, within a casing of the computing unit. Next, and at 620 a magnetic field can be created via the arrangement of ferromagnetic materials in the computing unit, to interact with magnetic fields of the magnetic anchor. For example, such interaction of magnetic fields can occur by spreading permanent magnets across a surface area of the computing unit and the magnetic anchor—wherein a movement of ferromagnetic material relative to each other—can facilitate magnetic coupling of the magnetic anchor to the computing unit. Such can include a twisting motion for a permanent magnet associated with the magnetic anchor.

Subsequently and at 630, such magnetic field can be employed for attaching the magnetic anchor to the computing unit, which in turn can be fastened to a secure location by employing a cable attached to the magnetic anchor. In one aspect, the magnetic field can be created from two magnets, which can be magnetized in a direction of their smallest dimension with portions of each having opposite magnetic polarity. Accordingly, in an "ON" position the magnets can exhibit magnetic polarity coinciding with each other, to reinforce a magnetic force combined together. Alternatively, in an "OFF" position the created magnetic polarity can result from opposition of the magnetic polarities—hence reducing flux of the magnets. By enabling an "ON" position, the magnetic anchor can be connected to the computing unit, wherein a cable attached to the magnetic anchor can subsequently connect the computing unit to a secured location at 640.

Figure 7:
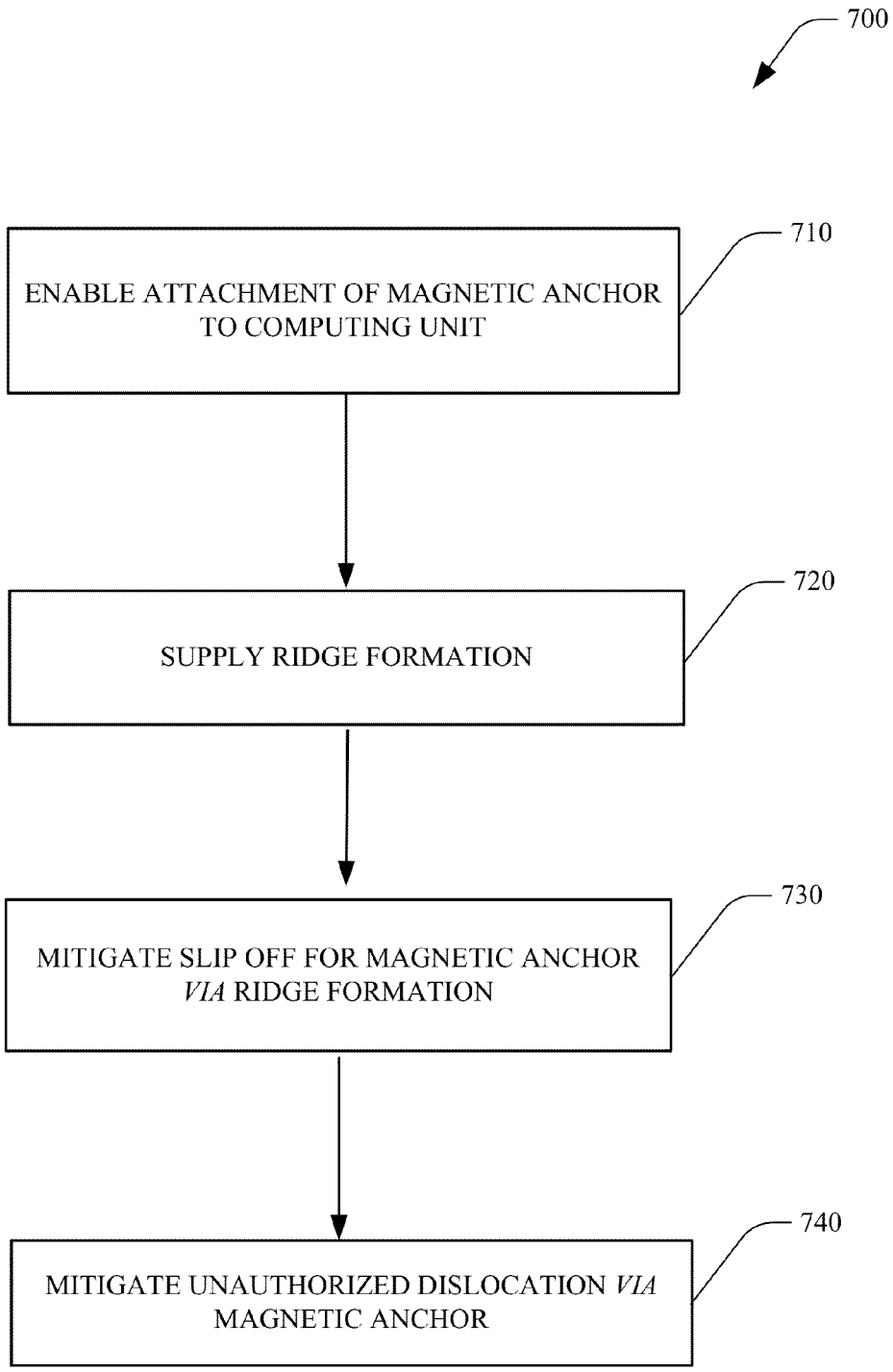
FIG. 7 illustrates a further methodology of employing a ridge formation as part of mitigating unauthorized dislocation.

FIG. 7 illustrates a related methodology 700 further aspect of the subject disclosure, which enables a magnetic "anchor" attachable to a surface area of a portable computing unit, to prevent its unauthorized relocation & movement. Initially, the ferromagnetic arrangement can be positioned in an "ON" configuration, to enable attachment of the magnetic anchor to the computing unit at 710. Subsequently, and at 720 a ridge formation can be supplied as part of a surface of the computing unit—wherein such ridge formation can include any type of configuration, such as rectangular, triangular, and the like, which can be raised from the surface of the computing unit. At 730, the ridge formation can be employed to mitigate a slip off for the magnetic anchor from the surface of the computing unit—wherein such ridge formation can act as a barrier. As such and at 740, the magnetic anchor can mitigate unauthorized dislocation of the computing unit (e.g., opportunistic theft) via a cable that is attachable to the magnetic anchor.

As mentioned, the techniques described herein can be applied to any suitable device. It is to be understood, therefore, that handheld, portable and other computing devices and computing objects of all kinds are contemplated for use in connection with the various embodiments. In addition to the various embodiments described herein, it is to be understood that other similar embodiments can be used or modifications and additions can be made to the described embodiment(s) for performing the same or equivalent function of the corresponding embodiment(s) without deviating there from. Still further, multiple processing chips or multiple devices can share the performance of one or more functions described herein, and similarly, storage can be affected across a plurality of devices. The subject disclosure is not to be limited to any single embodiment, but rather can be construed in breadth, spirit and scope in accordance with the appended claims.

What is claimed is:

1. An anti-theft system for a computing unit, comprising:

a cable attached to a magnetic anchor, the magnetic anchor includes ferromagnetic elements that magnetically couple to a surface of the computing unit; and a lock that controls switching of the magnetic anchor between an ON and OFF position, wherein the lock is simultaneously in contact with the anchor and the computing unit, and wherein the computing unit includes a ridge formation to mitigate a slip off for the magnetic anchor from the surface.

2. The anti-theft system of claim 1, wherein a movement of the ferromagnetic elements relative to each other facilitates the switching.

3. The anti-theft system of claim 2, wherein the ferromagnetic elements have a substantially planar arrangement.

4. The anti-theft system of claim 3, wherein the ferromagnetic elements include permanent disc shaped magnets.

5. The anti-theft system of claim 3, wherein the magnetic anchor is in contact with a back surface of a display associated with the computing unit.

6. The anti-theft system of claim 3, wherein the movement is a rotation.

7. The anti-theft system of claim 6 further comprising a cavity that receives a key for rotation of rotatable permanent magnets.

8. The anti-theft system of claim 1, wherein the lock is a combination lock or a biometric lock.

9. An anti-theft system, comprising:

a cable attached to a magnetic anchor, the magnetic anchor includes ferromagnetic elements that magnetically couple to a surface of the computing unit; and a lock that controls switching of the magnetic anchor between an ON and OFF position, wherein the computing unit includes a ridge formation to mitigate a slip off for the magnetic anchor from the surface.

10. An anti-theft system, comprising:

a cable attached to a magnetic anchor, the magnetic anchor includes ferromagnetic elements that magnetically couple to a surface of the computing unit; and a lock that controls switching of the magnetic anchor between an ON and OFF position wherein the lock is simultaneously in contact with the anchor and the computing unit, and wherein the computing unit includes a magnetic shield positioned between electrical components of the computing unit and the ferromagnetic elements.

11. A method of safe guarding a portable computing unit from an unauthorized relocation, comprising:

enabling magnetic coupling between a magnetic anchor and a computing unit by moving various magnets of the magnetic anchor relative to each other, the computing unit including a ridge formation to mitigate slip off for the magnetic anchor from a surface of the computing unit;

attaching the magnetic anchor to the computing unit;

fastening a cable of the magnetic anchor to a secure location; and securing the magnetic anchor to the computing unit with a lock, the lock being in simultaneous contact with the magnetic anchor and the computing unit.

12. The method of claim 11 further comprising employing two permanent magnets as part of the magnetic anchor.

13. The method of claim 12 further comprising rotating a first permanent magnet with respect to a second permanent magnet to create one of an ON or OFF position for the magnetic anchor.

14. The method of claim 13 further comprising positioning permanent magnets as part of the computing unit.

* * * * *